United States Patent [19]

Lindgren et al.

[11] 4,295,033

[45] Oct. 13, 1981

[54] ANNEALING OVEN

[75] Inventors: Håkan O. Lindgren; Bengt Magnusson, both of Hallstahammar, Sweden

[73] Assignee: Bulten-Kanthal Aktiebolag, Hallstahammar, Sweden

[21] Appl. No.: 923,968

[22] Filed: Jul. 12, 1978

[30] Foreign Application Priority Data

Jun. 20, 1977 [SE] Sweden ..... 7707127

[51] Int. Cl.[3] ..... H05B 3/40

[52] U.S. Cl. ..... 219/388; 165/96; 219/390

[58] Field of Search ..... 219/388 S, 390, 155, 219/534, 535, 550, 524, 300, 553; 432/8, 59, 247; 34/151, 152; 266/103; 148/156; 165/135, 96, 98

[56] References Cited

U.S. PATENT DOCUMENTS

| | | | |
|---|---|---|---|
| 1,956,737 | 5/1934 | Walker et al. | 219/388 |
| 1,971,387 | 8/1934 | Scoville | 219/535 |
| 2,420,373 | 5/1947 | Hogberg | 165/135 |
| 2,444,348 | 6/1948 | Hahn . | |
| 2,479,346 | 8/1949 | Goodnow . | |
| 2,896,060 | 7/1959 | Serfass et al. | 219/300 |
| 3,238,592 | 3/1966 | Killoran et al. | 219/300 |
| 3,296,354 | 1/1967 | Werych . | |
| 3,449,549 | 6/1969 | Isobe et al. | 432/8 |
| 3,461,519 | 8/1969 | Raschle | 432/59 |
| 3,506,804 | 4/1970 | Schippers et al. | 219/388 S |
| 3,598,955 | 8/1971 | Morelock . | |
| 3,607,475 | 9/1971 | Schrewelius | 219/553 |

FOREIGN PATENT DOCUMENTS

| | | | |
|---|---|---|---|
| 473319 | 5/1951 | Canada | 219/388 S |
| 1224346 | 9/1966 | Fed. Rep. of Germany . | |
| 1261872 | 2/1968 | Fed. Rep. of Germany . | |
| 1533986 | 5/1970 | Fed. Rep. of Germany . | |
| 375638 | 6/1932 | United Kingdom | 219/155 |
| 1073500 | 6/1967 | United Kingdom | 165/96 |

*Primary Examiner*—Gene Z. Rubinson
*Assistant Examiner*—Bernard Roskoski
*Attorney, Agent, or Firm*—Hill, Van Santen, Steadman, Chiara & Simpson

[57] ABSTRACT

An annealing oven for wire and the like includes a tubular elongated heater made of electrical resistance alloy material. The wire passing therethrough is so guided that it remains at all times out of contact with the heater and no current passes through the wire. Relatively movable sections of heat-insulating material laterally jacket the tube to facilitate threading a wire through a slot in the tube and so as to facilitate rigid heating with a minimum of heat loss, so as to adjust heat loss as a part of temperature control, and so as to effect rapid cooling of the tube. The sections are arranged in pairs, and a pair of such sections has a lesser insulating capacity than the preceding section, taken in the direction of wire movement. The device is compact and takes a minimum of space adjacent to any material processing machine.

4 Claims, 3 Drawing Figures

Fig. 1
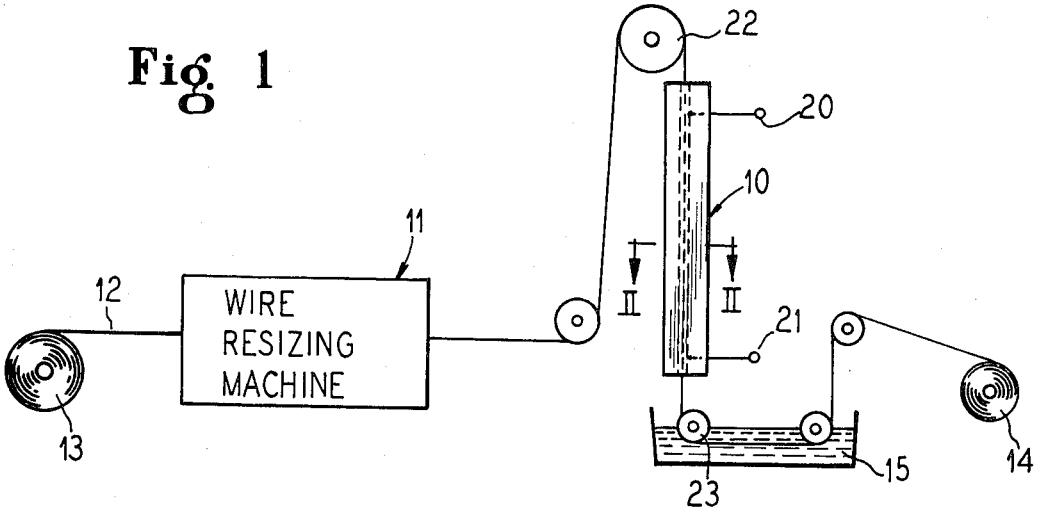
Fig. 2
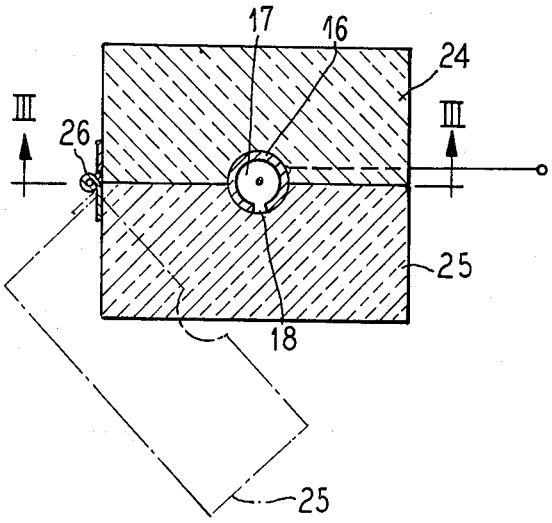
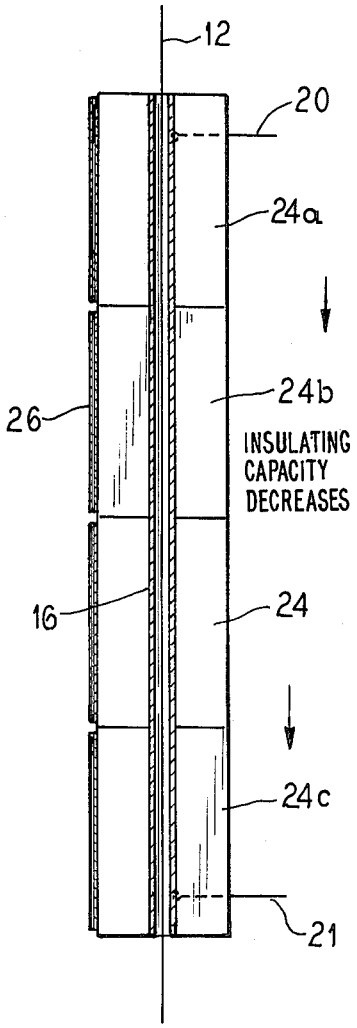
Fig. 3

ANNEALING OVEN

SUMMARY OF THE INVENTION

An annealing oven for wire and the like includes a tubular elongated heater through which the wire passes without contacting the heater. The heater is made of an electrical resistance alloy through which an electrical current passes. The tubular heater is preferably slotted and is preferably jacketed by a series of relatively movable sections of insulation which can be moved to facilitate threading of the wire and/or cooling of the heater.

The electrical resistance alloy is essentially molybdenumdisilicide. An annealing oven constructed in accordance with the invention enables it to be brought to operating temperatures rapidly, to cool relatively rapidly, to be used with an oxidizing atmosphere, to be used with a protective gas, and at all times to keep the wire being annealed out of contact with the heating element with no current passing through the wire.

DESCRIPTION OF THE DRAWING

FIG. 1 is a diagrammatic view of an annealing oven provided in accordance with the invention and shown in association with a wire processing machine;

FIG. 2 is an enlarged cross-sectional view taken along line II—II of FIG. 1; and FIG. 3 is a cross-sectional view taken along line III—III of FIG. 2.

DETAILED DESCRIPTION

FIG. 1 shows an annealing oven 10 for annealing wire, strip stock, rods and the like which have been referred to herein collectively as "wire". The oven 10 is shown installed in association with a wire resizing machine 11 such as a drawing machine or a rolling mill. A supply of wire 12 obtained from a source or spool 13 passes through the resizing machine 11 and emerges with a different cross-sectional configuration such as size, and is then guided through a system of pulleys to a take-up roll or drum 14. During movement of the wire through the pulley system, the wire passes through the annealing oven 10 and a bath 15 in this example.

The oven 10 includes as best shown in FIGS. 2 and 3, a tubular elongated heater 16 which has a passage 17 extending therethrough, the passage being open at both ends. The tubular heater 16 has an elongated slot 18.

The tubular heater 16 comprises an electrical resistance alloy material that is essentially molybdenumdisilicide, commercially available under the trademark KANTHAL SUPER, registered in Sweden, available from the assignee of this application. This material possesses high thermal stability in oxidizing atmospheres and has a high resistance to protective gases, such as a mixture of three parts of hydrogen gas to one part of nitrogen gas, even when hot, and has good electrical conductivity. Molybdenum-disilicide has low resistivity at room temperature, the resistivity increasing rapidly with rising temperature.

A pair of electrical terminals 20,21 are connected to the tubular heater at points spaced longitudinally along the length of the heater. The wire 12 is kept out of contact with the interior of the tubular heater 20, and to this end there is provided a guide structure in the form of a pair of pulleys 22,23 which in this instance also form a part of the pulley guide system. As best shown in FIGS. 2 and 3, the guide structure 22,23 keeps the wire 12 at all times out of contact with the tubular heater.

The tubular heater 16 is surrounded by heat insulating material formed as a pair of sections 24,25 that are selectively movable with respect to each other, there being a hinge 26 for this purpose in this embodiment. When the section 25 is pivoted to an open position, the slot 18 is readily accessible for facilitating easy threading of the device. Preferably, there is a plurality or series of such sections, others being identified at **24*a*,24*b* and 24*c*. In the direction that the wire travels, the sections 24–24*c*** progressively have a lesser insulating capacity than each preceding section.

In one embodiment, the tube 16 had an outer diameter of 9.9 mm and an innerdiameter of 6.0 mm. The operating temperature of the tube 16 was controlled to a temperature between 1000° C. and 1500° C. A wire with a diameter of 0.6 mm was annealed satisfactorily with a feed velocity of about 60 m/min.

A high tube temperature enables the use of a high wire velocity, and a lower tube temperature is compensated for by using a longer tube length where the annealing velocity remains the same. The temperature of the tubular heater 16 is controlled by regulating the supply of electric current to the tubular heater 16 and by opening and closing of the insulating sections. Furthermore, the opening of the insulating sections **24–24*c*** facilitates wire insertion and speeds up cooling of the tubular heater to room temperature. Further, this structure enables the user to compensate for other factors such as the velocity of the wire processing machine by adapting the annealing oven correspondingly such as by altering the effective length of the tube and/or its temperature. The annealing oven according to the invention requires only a minimal amount of space and therefore it can be disposed immediately adjacent to a material processing machine.

Since the tubular heater 16 is directly heated by electric current passing through it, the voltage needed can be kept low so that normally no inner protective coating or tube is needed. If operating circumstances necessitate a protective coating or tube, such can be provided without any resulting disadvantage. Energy consumption is low because the oven can be quickly heated and therefore it needs to be energized or heated only during actual production.

Although various minor modifications may be suggested by those versed in the art, it should be understood that we wish to embody within the scope of the patent warranted hereon, all such embodiments as reasonably and properly come within the scope of our contribution to the art.

We claim as our invention:

1. An annealing oven for wire and the like, comprising:

(a) a tubular elongated heater, open at both of its ends, there being a wire-receptive passage extending between said ends, said heater being made of an electrical resistance alloy, said alloy being essentially molybdenumdisilicide;

(b) a pair of electrical terminals connected to said heater at longitudinally spaced points;

(c) guide structure at each end of said heater and disposed to keep moving wire in said passage out of contact with said heater; and (d) at least one pair of sections of heat insulating material surrounding said heater, said sections being selectively movable, without disassembly, with respect to each other for regulating oven temperature.

2. An oven according to claim 1 including at least one pair of sections of heat insulating material surrounding said heater, said sections being selectably movable with respect to each other for regulating oven temperature.

3. An oven according to claim 1 including a plurality of pairs of said sections, said pairs being disposed successively along the length of said tubular-heater.

4. An oven according to claim 3, a pair of said sections having less insulating capacity than the preceding pair, taken in the direction of wire movement.

* * * * *